US007052593B2

(12) United States Patent
Wojcik, Jr. et al.

(10) Patent No.: US 7,052,593 B2
(45) Date of Patent: May 30, 2006

(54) PROCESS FOR THE PRODUCTION OF DIARYL IODONIUM COMPOUNDS

(75) Inventors: Leonard H. Wojcik, Jr., Holladay, UT (US); David D. Cornell, Kingsport, TN (US)

(73) Assignee: Cornell Development Corporation LLC, Kingsport, TN (US)

( * ) Notice: Subject to any disclaimer, the term of this patent is extended or adjusted under 35 U.S.C. 154(b) by 213 days.

(21) Appl. No.: 10/753,588

(22) Filed: Jan. 7, 2004

(65) Prior Publication Data

US 2005/0145504 A1 Jul. 7, 2005

(51) Int. Cl.
*C25B 3/00* (2006.01)
*C25B 3/06* (2006.01)

(52) U.S. Cl. ..... 205/463; 205/424; 205/426; 205/427; 205/438; 205/444; 205/456; 205/459

(58) Field of Classification Search ..... 205/424, 205/426, 427, 438, 444, 456, 459, 463
See application file for complete search history.

(56) References Cited

U.S. PATENT DOCUMENTS

| | | | | |
|---|---|---|---|---|
| 3,885,036 | A | 5/1975 | Moyle | 424/275 |
| 4,513,137 | A | 4/1985 | Koser et al. | 546/14 |
| 4,759,833 | A * | 7/1988 | Lentz et al. | 205/338 |
| 5,277,767 | A | 1/1994 | Cushman et al. | 204/59 R |
| 6,419,814 | B1 | 7/2002 | Pletcher et al. | 205/463 |
| 6,620,305 | B1 | 9/2003 | Cornell et al. | 205/413 |

* cited by examiner

*Primary Examiner*—Edna Wong
(74) *Attorney, Agent, or Firm*—Bell Boyd & Lloyd LLC

(57) ABSTRACT

The present invention provides an electrochemical method for producing diaryl iodonium compounds wherein application of an electric current to an electrochemical cell containing a reaction mixture composed of a solvent, an iodoaryl compound and an electrolyte forms an oxidizing agent in situ. In this first step, the oxidizing agent is subsequently converted into a stable oxidized iodoaryl intermediate, typically an iodosyl compound. The electric potential is removed and in a second step a target aryl compound is introduced to the reaction mixture to react with the oxidized iodoaryl intermediate to form a diaryl iodonium compound.

29 Claims, No Drawings

PROCESS FOR THE PRODUCTION OF DIARYL IODONIUM COMPOUNDS

CROSS-REFERENCE TO RELATED APPLICATIONS

Not applicable.

FEDERALLY SPONSORED RESEARCH OR DEVELOPMENT

Not applicable.

FIELD OF THE INVENTION

The present invention relates to an electrochemical method of producing diaryl iodonium compounds, and in particular, to a method for the in situ formation of an oxidizing agent and corresponding oxidized iodoaryl intermediate without isolation in the production of the diaryl iodonium compound.

BACKGROUND OF THE INVENTION

Chemical and electrochemical methods are known for the synthesis of diaryliodonium salts. U.S. Pat. No. 3,885,036 discloses the preparation of a mixed heterocyclic/carbocyclic iodonium compound, specifically 4-chlorophenyl-2-thienyliodonium salt, by reacting the iodosyl compound, isolated and purified 4-chloroiodosobenzene diacetate, with thiophene and an anion source. The method disclosed in U.S. Pat. No. 3,885,036, however, requires a separate quantity of peracid in order to prepare the iodosyl compound or the use of toxic lead compounds. Subsequent isolation and purification of the iodosyl compound is expensive and poses significant risk of spontaneous detonation as unstable and explosive iodoxyl compounds may be formed.

U.S. Pat. No. 5,277,767 discloses a method for electrochemically synthesizing diaryl iodonium salts in an undivided cell utilizing carbon electrodes, acetic acid as the solvent, and sulfuric acid as the electrolyte. However, only aryl compounds resistant to oxidation/decomposition in the presence of an electric current are suitable for use as a target aryl compound.

Known conventional electrochemical processes for the formation of diaryliodonium salts from benzene or toluene and iodobenzene utilizing divided cells have proven to be commercially impractical as a high voltage drop is involved in these processes. The semi-permeable membranes associated with divided cell use are also problematic. These processes also require expensive platinum electrodes, further diminishing the appeal of employing such methods.

A need exists for a method of producing diaryl iodonium compounds that does not require large amounts of concentrated and unstable starting reagents such as peracids and/or peroxides and also eliminates the hazards associated with the isolation and purification of iodosyl compounds. A need further exists for a method of producing diaryl iodonium compounds which accommodates labile target aryl compounds sensitive to degradation when exposed to oxidizing and reducing environments in an undivided electrochemical cell.

SUMMARY OF THE INVENTION

The present invention provides a method for the production of diaryl iodonium salts, in particular salts with labile components, without the use of large amounts of hazardous, unstable, and expensive peracids and/or peroxides or the generation of explosive byproducts. The method includes introducing a reaction mixture composed of a solvent, an iodoaryl compound, and an electrolyte into an electrochemical cell having an anode and a cathode. An electric potential is applied to the reaction mixture through the anode and cathode to form an oxidizing agent. The formed oxidizing agent immediately or nearly spontaneously reacts with, converts to, or otherwise combines with the iodoaryl compound to form a stable oxidized iodoaryl intermediate. Typically, the oxidized iodoaryl intermediate is an iodosyl compound. The electric potential is then removed from the reaction mixture and an aryl compound, i.e., the target aryl compound, is added thereto. The target aryl compound reacts with the oxidized iodoaryl intermediate in the absence of the electric potential to form a diaryl iodonium compound. An advantage of this two-step synthesis is that the reaction products and reactants of the first step may be used for the second step without isolation or purification.

The entire reaction may occur in a single reaction vessel, namely the electrochemical cell. Alternatively, the target aryl compound may be reacted with the oxidized iodoaryl intermediate in a separate vessel in the absence of the electric potential. The amount of oxidizing agent formed may be controlled by adjustment of the cell parameters such as temperature, pressure, voltage, amperage and duration of applied potential. As a result, only a discrete amount of oxidizing agent is formed and is subsequently readily converted into the stable iodosyl intermediate. Addition of the target aryl compound to the reaction mixture forms the diaryl iodonium compound without the need to isolate or purify the iodosyl intermediate. Thus, the risk of hazardous iodoxyl byproduct exposure is eliminated.

The diaryl iodonium compound is preferably retrieved as a salt. Upon formation of the diaryl iodonium compound, the method preferably includes introducing a reducing agent to the reaction mixture to reduce any residual or unconverted oxidizing agent into an acid. An inorganic salt is then added to precipitate the diaryl iodonium compound as a salt.

Preferably, acetic acid is used as the solvent resulting in the formation of peracetic acid as the oxidizing agent. The solvent and/or the electrolyte, however, may contribute to. the formation of the oxidizing agent. The peracetic acid subsequently converts to an iodosyl diacetate compound.

The present method may be used to synthesize carbocyclic-carbocyclic, heterocyclic-heterocyclic or mixed carbocyclic-heterocyclic diaryl iodonium compounds. The present method is particularly useful when a fragile or otherwise labile aryl compound, i.e., an aryl compound readily oxidized at an electrically-active anode or reduced at a cathode, is used as the target aryl compound. A labile aryl compound is a carbocyclic or heterocyclic compound that oxidizes, reduces, decomposes, or otherwise degrades in an electron withdrawing or electron donating environment. The degraded labile aryl compound is often tar-like. The present method is suitably adapted for labile aryl compounds as the electric current is removed from the cell prior to addition of the target aryl compound. The method is preferably used to synthesize mixed carbocyclic-heterocyclic diaryl iodonium products wherein the target aryl compound is an easily oxidized aryl compound such as a thiophene, for example.

The present invention may be chemically represented as set forth below.

$$2CH_3COOH+2H_2O \rightarrow 2CH_3COO_2H+4H^+ \quad (1a)$$

$$2CH_3COO_2H+ArI \rightarrow ArI(OAc)_2+2OH^- \quad (1b)$$

In sum, (1a) and (1b) yield $$2CH_3COOH + ArI \rightarrow ArI(OAc)_2 + H_2 \text{(at cathode)}$$

(2)

$$ArI(OAc)_2 + Ar' \xrightarrow[\text{no current}]{} (Ar—I—Ar')^+(OAc)^- + HOAc$$

(3)

$$CH_3COO_2H + NaHSO_3 \xrightarrow[\text{no current}]{} CH_3COOH + NaHSO_4$$

(4)

$$KBr + (Ar—I—Ar')^+(OAc)^- \xrightarrow[\text{no current}]{} (Ar—I—Ar')^+Br^-_{(ppt)} + K(OAc)$$

wherein ArI is an iodoaryl compound, Ar' is an aryl compound, HOAc is acetic acid and $(OAc)^-$ is an acetate anion. Reactions (1a) and (1b) typically occur substantially simultaneously.

These and other aspects and attributes of the present invention will be discussed with reference to the accompanying specification.

BRIEF DESCRIPTION OF THE DRAWINGS

Not applicable.

DETAILED DESCRIPTION OF THE INVENTION

While this invention is susceptible of embodiment in many different forms, as will be described herein in detail, specific embodiments thereof with the understanding that the present disclosure is to be considered as an exemplification of the principles of the invention and is not intended to limit the invention to the specific embodiments illustrated.

The reagents utilized in the present method include an iodoaryl compound, an aryl compound, a solvent and an electrolyte. The initial reaction mixture omits the aryl compound and includes the iodoaryl compound, the solvent and the electrolyte. Although the reaction mixture utilizes an iodoaryl compound, the skilled artisan will acknowledge that any haloaryl compound (i.e., chloroaryl or bromoaryl) may be used without detracting from the scope of the present invention. The iodoaryl compound may be either heterocyclic or carbocyclic with carbocyclic compounds having at least six carbon atoms such as benzene, toluene and naphthalene being preferred. In addition to the substituted iodine atom, the iodoaryl compound may be further substituted with groups such as the same or other halides, alkyl groups having 1 to 18 carbon atoms, vinyl groups, nitro groups, amines, carboxylic acids, esters, ethers and combinations thereof. The iodoaryl compound may also be heterocyclic with or without substitution. Whether carbocyclic or heterocyclic, it is important that the iodoaryl compound possess sufficient stability not to decompose when subjected to an electric potential as will be discussed hereinafter. Nonlimiting examples of suitable iodoaryl compounds include iodotoluene, iodobenzene, and iodonaphthalene wherein each compound may be unsubstituted or substituted with 1 or more substituents.

The aryl compound subsequently introduced into the reaction mixture (as explained in detail below) may be a carbocyclic compound containing at least six carbon atoms or a heterocyclic compound containing at least four carbon atoms and an oxygen, nitrogen, or sulfur atom. The aryl compound is distinguished from the iodoaryl compound in that the latter does not decompose in an electrically-charged undivided cell and the former may decompose in an electrically charged environment. The aryl compound may be substituted with groups such as halides (i.e., F, I, Br, or Cl), alkyl groups having 1 to 18 carbon atoms, vinyl groups, carboxylic acids or esters, ethers, and the like. Preferably, the aryl compound is a heterocyclic aromatic compound. Nonlimiting examples of suitable heterocyclic compounds include pyridine, pyrrole, furans or other polycyclic aromatic compounds. Most preferred for the aryl compound is thiophene. In general, the optional substituents on the aryl and iodoaryl compounds may be any group or groups that do not have an adverse effect on the preparation of the desired diaryl iodonium compound.

The first step of the method of the invention is practiced using a solvent/reactant for the iodoaryl compound, an iodoaryl compound, and the electrolyte. The solvent/reactant may be a polar solvent with acyclic polar solvents preferred. Nonlimiting examples of solvents suitable for use with the present invention are halogenated hydrocarbons such as dichloromethane and chloroform, organic acids, and the like. Suitable organic acids may include without limitation formic acid, acetic acid, and trifluoroacetic acid. Most preferred is acetic acid.

The solvent preferably includes an electrolyte which will conduct an electric current while not adversely affecting the preparation of the desired intermediate compound. In addition, the electrolyte may function partially or totally as the reacting solvent to form an oxidizing agent such as a peracid. Examples of suitable electrolytes include, but are not limited to, strong acids such as p-toluene-sulfonic acid, phosphoric acid, and preferably sulfuric acid. Other suitable electrolytes may include inorganic and/or organic salts including ammonium tetrafluoroborate and other fluorine containing compounds.

The first step of the method is performed in an undivided or single compartment electrolytic cell equipped with a cathode and an anode. The composition of the anode is important in obtaining current efficiency. A non-reactive anode is preferred. Materials suitable for use as the anode include, but are not limited to, carbon, platinum, nickel, tantalum, titanium, nickel-copper alloy commonly known as Monel™, and vanadium. Materials such as these promote formation of an oxidizing agent such as a peracid, without reacting with the oxidizing agent. Materials most preferred for the anode include carbon electrodes, such as vitreous carbon, graphitic carbon, and graphite. The choice of the cathode for use in the process of the invention is determined by low hydrogen overvoltage and lack of adverse reactions. Nonlimiting materials suitable for use as the cathode include zinc, platinum, nickel, cadmium, tin, copper, stainless steel, vanadium, carbon, and the like.

The single compartment electrolytic cell is charged with the reaction mixture composed of the iodoaryl compound, the solvent, and the electrolyte in any order. In addition, a drying agent may be added to the reaction mixture, preferably in an amount from about 1% to about 25% by weight of the reaction mixture. A preferred drying agent is acetic anhydride. An electric potential is subsequently applied to the anode and cathode. The electric potential may range from about 1 volt to about 25 volts, depending on the cell configuration and electrode spacing. The electric potential is applied for about 1 hour to about 10 hours. The reaction environment may be varied as desired. For example, the temperature of the cell may range between about 5° C. to about 65° C. The pressure of the cell may range from about 1 atm to about 5 atm. As is commonly known in the art, the electrical conductivity of the solution increases as temperature is raised from room temperature to the boiling point of one of the reactants. The electric potential may be applied to the anode and cathode as a constant electric potential or as a constant amperage. It has been found that applying the electric potential intermittently may promote the formation of the oxidized iodoaryl intermediate. It is therefore preferred to cycle the electricity on and off while maintaining circulation of the reaction mixture. While the electric potential may be applied as direct current, it has also been found that the use of alternating current may further promote formation of the oxidized iodoaryl intermediate. It is understood that agitation of the reaction mixture promotes formation of the oxidized iodoaryl intermediate. Blanketing the reaction mixture in an inert environment by filling the headspace of the electrochemical cell with an inert gas (i.e., He, $N_2$, Ar, or Kr) during application of the electric potential further promotes formation of the oxidized iodoaryl intermediate.

The electric potential is applied to the reaction mixture until a sufficient number of coulombs of electricity have passed through the solution to create the oxidizing agent. Typically, the electric current oxidizes the solvent or electrolyte to form a peracid. For example, when the solvent is acetic acid, application of the electric current to the reaction mixture produces peracetic acid. The electrolyte may also function in the formation of the oxidizing agent. Thus, applying the electrical current to strong electrolytic acids such as p-toluene-sulfonic acid, phosphoric acid and sulfuric acid may oxidize each acid into its respective peracid.

Upon formation of the oxidizing agent, the oxidizing agent readily combines with the iodoaryl compound to form an oxidized iodoaryl intermediate. Not wishing to be bound by theory, it is believed that as the oxidizing agent forms, it readily combines with, is readily consumed by, or spontaneously reacts with the iodoaryl compound to form the oxidized iodoaryl intermediate. The formed oxidized iodoaryl intermediate is preferably an iodosyl compound. Nonlimiting examples of suitable oxidized iodoaryl intermediates include iodosyl diacetate when acetic acid is the solvent or electrolyte, iodosyl diformate when formic acid is the solvent or electrolyte, iodosyl ditosylate when p-toluene sulfonic acid is the solvent or electrolyte and iodosyl disulfate when sulfuric acid is the solvent or electrolyte.

The present invention advantageously provides for in situ synthesis of the oxidizing agent within the cell. The skilled artisan will appreciate that with manipulation of the reaction environment parameters—i.e., cell temperature and pressure and current variables (voltage, amperage and duration of electric current applied)—the amount of formed oxidizing agent may be controlled to a high degree. The reaction environment parameters may thereby be adjusted to create any desired amount of oxidizing agent with little or no excess thereof. The present invention consequently eliminates the need for large quantities of high concentrations of hazardous, unstable and expensive peroxides and peracids previously necessary for the formation of iodosyl compounds. This reduces the hazards to personnel, equipment and the environment associated with the handling, storage and transport of such chemicals. In addition, the in situ formation of the oxidizing agent creates peracids inexpensively and safely and quickly converts the peracid at low concentration to the stable oxidized iodoaryl intermediate, typically an iodosyl compound.

Once a sufficient number of coulombs of electricity have passed to create a desired amount of oxidizing agent and corresponding oxidized iodoaryl intermediate, the electric current is turned off removing the electric potential from the reaction mixture. In the second step of the method, the target aryl compound is subsequently introduced into the cell in the absence of the electric potential. Alternatively, the target aryl compound may be combined with the reaction mixture containing the stable oxidized iodoaryl intermediate in a separate vessel other than the electrochemical cell. In either case, the target aryl compound is introduced in the absence of the electric potential. The aryl compound reacts with the oxidized iodoaryl intermediate to form a diaryl iodonium compound, typically a diaryl iodonium cation. The reaction mixture is preferably mixed or agitated during the addition of the aryl compound.

The present invention requires no isolation, separation or purification of the oxidized iodoaryl intermediate prior to reaction with the target aryl compound. Formation of highly unstable and explosive by-products such as iodoxyl or iodyl compounds during isolation or retrieval of the oxidized iodoaryl intermediate (i.e., an iodosyl or iodoso compound) is eliminated. Consequently, the present invention significantly reduces the risk of spontaneous detonation commonly known to be present during isolation of iodosyl compounds using conventional techniques.

As the electric potential is removed from the reaction mixture upon formation of a desired amount of oxidizing agent, the present invention is well-suited for reacting a labile aryl compound with the oxidized iodoaryl intermediate. A labile aryl compound is an aryl compound (carbocyclic or heterocyclic) that readily oxidizes in an electron withdrawing environment, such as the area proximate to an electrically active anode, or readily reduces in an electron donating environment, such as the area proximate to an electrically active cathode. Thus, a labile aryl compound is a compound that decomposes at an electrode in the presence of an electric current. Nonlimiting examples of labile aryl compounds include substituted benzene, phenyl groups, substituted naphthalene, naphthyl groups, pyrrole, pyrazole, imidazole, indole, pyridine, pyridazine, pyrimidine, quinoline, piperidine, pyrrolidine, thiazole, purine, thiophene, benzothiophene and furan. Preferably, the aryl compound added to the reaction mixture is a labile heterocyclic aryl compound with thiophene being most preferred.

Prior to precipitation and retrieval of the diaryl iodonium cation product, it is preferred to add a reducing agent to the reaction mixture to reduce any residual oxidizing agent remaining in the reaction mixture. Any suitable reducing agent may be used which does not adversely affect the oxidized iodoaryl intermediate, the iodoaryl compound, the aryl compound or the diaryl iodonium compound. A preferred reducing agent is sodium hydrogen sulfite, which will reduce any residual peracid to its respective acid and sodium hydrogen sulfate. Any inorganic salt, potassium bromide being preferred, may be added to the reaction mixture to precipitate the diaryl iodonium cation as a salt as is commonly known in the art. Removing the oxidizing agent from the reaction mixture prevents the halide anion of the inorganic salt, such as bromine, from oxidizing to elemental form, i.e., $Br_2$.

The diaryl iodonium salts, and mixed heterocyclic-carbocyclic diaryl iodonium salts in particular, synthesized by application of the present method are potent biocides with low toxicity to fish, mammals and plants, and high toxicity to microbes such as bacteria and anthrax in particular, fingi, spores, roundworm, flukes, and algae. Diaryl iodonium salts also have useful applications as photoinitiators and catalysts for photoinitiators.

The invention is further illustrated by the following non-limiting examples.

EXAMPLE 1

In an undivided electrochemical cell was placed 3.582 grams iodobenzene (0.0176 moles), 1.47 grams of thiophene (0.0176 moles), 7.4 grams sulfuric acid, 42 grams glacial acetic acid, and 6.5 grams acetic anhydride. Carbon electrodes were used for the cathode and the anode. The mixture was electrolyzed at 15° C. and a constant current until 1,003 Coulombs of charge (25% of theoretical) had passed, assuming two moles of electrons are needed per mole of iodosyl compound and one mole of iodosyl compound is needed per mole of iodonium compound. Given this amount of electrical power, the voltage rose from 8.5 volts to 24 volts as the current fell. The current was subsequently turned off. The reaction mixture was opaque with tarry material in the liquid and on the electrodes. 150 ml of water and then 150 ml of hexane were added to the reaction mixture and the resultant mixture was well stirred. The reaction mixture separated into organic and aqueous phases. To the aqueous phase was added 0.425 grams of $NaHSO_3$ and the reaction mixture was stirred. An excess of KBr was added to recover the phenyl thienyl iodonium cation as the bromide salt. No iodonium bromide was found.

EXAMPLE 2

In an undivided electrochemical cell was placed 3.646 grams iodobenzene (0.0179 moles), 7.4 grams sulfuric acid, 42 grams glacial acetic acid, and 6.5 grams acetic anhydride. Carbon electrodes were used for the cathode and the anode. The mixture was electrolyzed at 15° C. and a constant current until 4,000 Coulombs of charge (93% of theoretical) had passed, assuming two moles of electrons are needed per mole of iodosyl compound and one mole of iodosyl compound is needed per mole of iodonium compound. The current was subsequently turned off. To the resulting mixture 1.5 grams of thiophene (0.0179 moles) was added and well stirred. 150 ml of water and then 150 ml of hexane were added to the reaction mixture and the resultant mixture was well stirred. The reaction mixture separated into organic and aqueous phases. To the aqueous phase was added 0.425 grams of $NaHSO_3$ and the reaction mixture was stirred. An excess of KBr was added and the phenyl thienyl iodonium cation was recovered as the bromide salt. The yield of iodobenzene to iodonium salt was 59.3%. Excess iodobenzene may be recycled.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A method for the preparation of a diaryl-iodonium compound comprising:

introducing into an electrochemical cell having an anode and a cathode a reaction mixture composed of a solvent, an electrolyte, and an iodoaryl compound;

applying an electric potential to the reaction mixture to form an oxidizing agent, the oxidizing agent combining with the iodoaryl compound to form an oxidized iodoaryl intermediate; and reacting an aryl compound with the oxidized iodoaryl intermediate in the absence of the electric potential to form a diaryl-iodonium compound.

2. The method of claim 1, further comprising introducing a reducing agent after formation of the diaryl-iodonium compound to reduce any excess oxidizing agent.

3. The method of claim 2, further comprising introducing a salt to form a precipitated diaryl-iodonium salt.

4. The method of claim 1, wherein substantially all of the formed oxidizing agent is converted into the oxidized iodoaryl intermediate.

5. The method of claim 1, wherein the oxidizing agent is formed from the group consisting of the electrolyte, the solvent and a combination thereof.

6. The method of claim 1 wherein the iodoaryl compound is selected from the group consisting of carbocyclic compounds and heterocyclic compounds.

7. The method of claim 6, wherein the iodoaryl compound is a carbocyclic compound and contains at least six carbon atoms.

8. The method of claim 6, wherein the iodoaryl compound is a heterocyclic compound and contains at least four carbon atoms and an atom selected from the group consisting of oxygen, sulfur, and nitrogen.

9. The method of claim 6, wherein the iodoaryl compound is further substituted with 1 to 5 substituents selected from the group consisting of halides, alkyl groups having 1 to 18 carbon atoms, vinyl groups, nitro groups, amines, carboxylic acids, esters, ethers and combinations thereof.

10. The method of claim 9, wherein the iodoaryl compound is selected from the group consisting of iodotoluene, iodobenzene, and iodonaphthalene.

11. The method of claim 1, wherein the solvent is selected from the group consisting of polar solvents, acyclic polar solvents, halogenated hydrocarbons and organic acids.

12. The method of claim 11, wherein the solvent is acetic acid.

13. The method of claim 12, wherein the oxidizing agent is peracetic acid and the oxidized iodoaryl intermediate is iodosyl diacetate.

14. The method of claim 1, wherein the electrolyte is selected from the group consisting of p-toluene-sulfonic acid, sulfuric acid, phosphoric acid, $NH_3HF$, HF, inorganic salts, organic salts and combinations thereof.

15. The method of claim 1, further comprising introducing a drying agent into the reaction mixture.

16. The method of claim 15, wherein said drying agent is acetic anhydride.

17. The method of claim 1, further comprising applying the electric potential for about 1 hour to about 10 hours.

18. The method of claim 1, wherein the electric potential is selected from the group consisting of direct current and alternating current.

19. The method of claim 1, further comprising applying the electric potential intermittently.

20. The method of claim 1, wherein the anode is composed of a material selected from the group consisting of carbon, graphitic carbon, platinum, nickel, tantalum, titanium, nickel-copper alloy, and vanadium.

21. The method of claim 1, wherein the aryl compound is selected from the group consisting of a heterocyclic compound and a carbocyclic compound.

22. The method of claim 21, wherein the aryl compound is a labile aryl compound.

23. The method of claim 22, wherein the labile aryl compound is selected from the group consisting of phenyl groups, naphthyl groups, pyrrole, pyrazole, imidazole, indole, pyridine, pyridazine, pyrimidine, quinoline, piperidine, pyrrolidine, thiazole, purine, thiophene, benzothiophene and furan.

24. The method of claim 23, wherein the aryl compound is further substituted with 1 to 5 substituents selected from the group consisting of halides, alkyl groups having 1 to 18 carbon atoms, vinyl groups, nitro groups, amines, amides, hydroxyls, carboxylic acids, esters, ethers and combinations thereof.

25. The method of claim 1 wherein the electrochemical cell has a headspace, the method further comprising filling the headspace with an inert gas.

26. The method of claim 25 wherein the inert gas is nitrogen.

27. A method for the preparation of a diaryl-iodonium compound comprising:

(a) introducing into an electrochemical cell having an anode and a cathode a reaction mixture composed of a solvent, an electrolyte, and an iodoaryl compound;

(b) forming an oxidizing agent by applying an electric potential to the cathode and anode;

(c) reacting substantially simultaneously with (b) the iodoaryl compound with the oxidizing agent to form an oxidized iodoaryl intermediate; and (d) adding an aryl compound to the intermediate in the absence of the electric potential to form a diaryl-iodonium compound.

28. A method for the preparation of a diaryl-iodonium compound comprising:

introducing into an electrochemical cell having an anode and a cathode a reaction mixture composed of a solvent, an iodoaryl compound, and an electrolyte;

applying an electric potential to the cathode and anode to form an oxidizing agent;

converting the oxidizing agent into an oxidized iodoaryl intermediate; and reacting an aryl compound with the oxidized iodoaryl intermediate in the absence of the electric potential to form a diaryl-iodonium compound.

29. The method of claim 28, wherein said converting occurs as the oxidizing agent is formed.

* * * * *